US005867056A

United States Patent [19]

Zoellick

[11] Patent Number: 5,867,056

[45] Date of Patent: Feb. 2, 1999

[54] VOLTAGE REFERENCE SUPPORT CIRCUIT

[75] Inventor: Raymond D. Zoellick, Bothell, Wash.

[73] Assignee: Fluke Corporation, Everett, Wash.

[21] Appl. No.: 970,916

[22] Filed: Nov. 14, 1997

[51] Int. Cl.[6] ..... G05F 1/46; G05F 3/02

[52] U.S. Cl. ..... 327/541; 327/513; 327/543; 327/546; 323/314

[58] Field of Search ..... 327/538, 539, 327/540, 541, 513; 323/312, 313, 314, 316, 907; 328/542, 543, 546

[56] References Cited

U.S. PATENT DOCUMENTS

| | | | |
|---|---|---|---|
| 5,307,315 | 4/1994 | Oowaki et al. | 327/538 |
| 5,315,231 | 5/1994 | Linder et al. | 323/315 |
| 5,319,303 | 6/1994 | Yamada | 323/313 |
| 5,329,184 | 7/1994 | Redfern | 326/66 |
| 5,506,541 | 4/1996 | Herndon | 327/541 |

*Primary Examiner*—Timothy P. Callahan
*Assistant Examiner*—Terry L. Englund

[57] ABSTRACT

A reference voltage support circuit that interfaces with a variety of reference voltage circuit types including bandgap references, zener references, and reference amplifiers with only the interconnection details being different. The reference voltage support circuit contains a voltage source to produce a stabilized supply current for the reference voltage circuit and a unity gain voltage inverter to produce both positive and negative reference voltages from a unipolar reference voltage circuit. The current source and the unity gain voltage inverter both employ ratiometrically scaled resistor networks coupled to the negative and positive reference voltages for high stability over time and temperature.

12 Claims, 3 Drawing Sheets

VOLTAGE REFERENCE SUPPORT CIRCUIT

BACKGROUND OF THE INVENTION

This invention relates generally to voltage reference circuits and in particular to a support circuit for supporting various types of voltage reference circuits including bandgap reference circuits, zener reference circuits, and reference amplifier circuits.

Voltage reference circuits provide a reference voltage that is independent of temperature and supply voltage variations. The reference voltage is provided to other circuits that depend on a known, stable voltage to operate properly, including for example analog to digital converters (ADCs), digital to analog converters (DACs), filters, and other analog integrated circuits.

Various circuit topologies exist for voltage reference circuits including bandgap reference circuits, zener reference circuits, and reference amplifier circuits. Bandgap reference circuits are well known in the art for generating reference voltages by balancing the temperature coefficients of multiple semiconductor diode and transistor junctions. Zener reference circuits employ the precise junction voltage settings of a reference zener which is commonly understood to be a combination of forward-biased zener diode and a silicon diode. The reference zener is biased with a known bias current. Reference amplifier circuits use the voltage settings of the base emitter voltage across a transistor which is operated at a specific collector current in conjunction with a zener diode biased at specific zener current to achieve substantially a zero temperature coefficient output voltage.

Each of the types of voltage reference circuits require additional support circuitry around them in the form of output buffers, amplifiers, or dividers to obtain the desired reference voltage. Furthermore, if both negative and positive reference voltages are required, additional inverting buffers are required. A voltage or current regulator is typically supplied in order to deliver a more stable supply voltage or bias current to the voltage reference circuit in order to improve its stability. Such support circuits typically have been implemented as specific designs for each particular application and have been re-designed for each new application.

Furthermore, most voltage reference circuit designs involve circuits that are implemented on an integrated circuit level, taking advantage of the complementary negative and positive temperature coefficients of various semiconductor junctions on the same substrate. Such designs allow for generally good performance in obtaining a reference voltage in one polarity but provide no provision for easily generating the reference voltage in the opposite polarity in a manner that allows for amplitude tracking between the positive and negative voltages.

Therefore, it would be desirable to provide a reference voltage support circuit that may accommodate a variety of voltage references, including bandgap reference circuits, zener reference circuits, and reference amplifier circuits. The reference voltage support circuit provides a stabilized supply current to the voltage reference and generates both negative and positive reference voltages from the voltage reference circuit. It would be further desirable that the amplitudes of the negative and positive reference voltages track each other closely over time and temperature with a minimal amount of additional circuitry.

SUMMARY OF THE INVENTION

In accordance with the present invention, a reference voltage support circuit is provided that interfaces with a variety of types of reference circuits in order to produce a stabilized bias current for the reference voltage circuit and further produces positive and negative reference voltages from the reference voltage circuit.

The reference voltage support circuit includes positive and negative reference voltage terminals labeled $+V_{ref}$ and $-V_{ref}$ across which is developed the reference voltage from the reference voltage circuit and further includes positive and negative supply terminals labeled $+V_z$ and $-V_z$ across which is developed the supply voltage to the reference voltage circuit. The reference voltage support circuit is capable of supporting a variety of types of reference voltage circuits, including bandgap reference circuits, zener reference circuits, and reference amplifier circuits, with only the interconnection details being different. The reference voltage support circuit thus provides for time savings in circuit design by the use of a single standardized design and further allows the voltage reference support circuit to be produced as a monolithic integrated circuit device if desired or simply added on to the same integrated circuit that includes the reference voltage circuit to achieve manufacturing cost savings and reduction in component count for a common circuit function.

One object of the present invention is to provide a voltage reference support circuit.

An additional object of the present invention is to provide a voltage reference support circuit that accommodates a variety of voltage reference circuit types.

A further object of the present invention is to provide a voltage reference support circuit that produces negative and positive reference voltages from a reference voltage circuit.

Another object of the present invention is to provide a voltage reference support circuit that produces positive and negative reference voltages that closely track each other over time and temperature.

Other features, attainments, and advantages will become apparent to those skilled in the art upon a reading of the following description when taken in conjunction with the accompanying drawings.

DETAILED DESCRIPTION OF THE INVENTION

Figure 1:
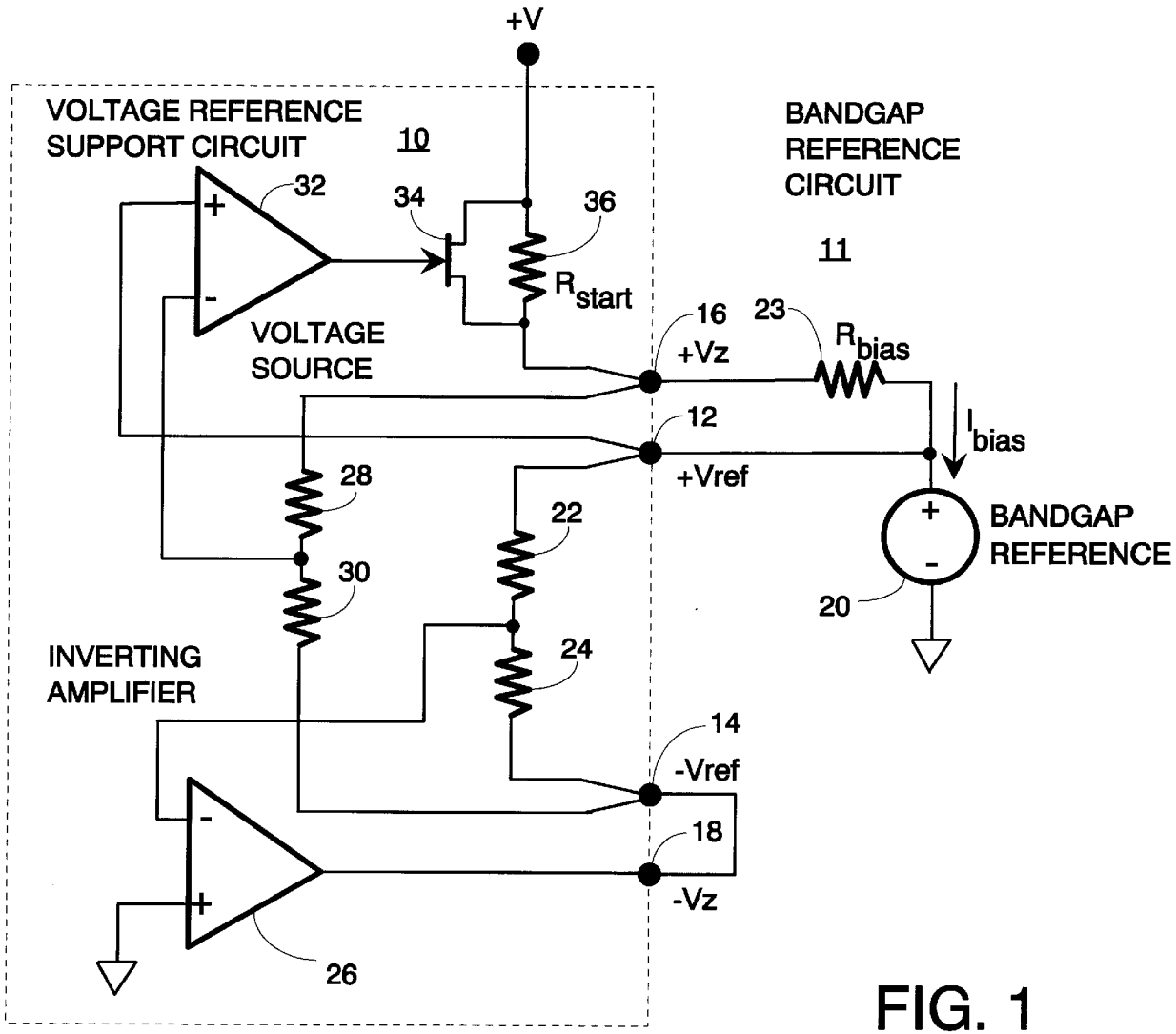
FIG. 1 is a schematic drawing of a voltage reference support circuit according to the present invention coupled to a bandgap reference circuit.

In FIG. 1, there is shown a schematic drawing of a voltage reference support circuit 10 according to the present invention as applied in supporting a voltage reference circuit in the form of a bandgap reference circuit 11. The voltage reference support circuit 10 has a positive reference terminal 12 and a negative reference terminal 14 labeled $+V_{ref}$ and $-V_{ref}$ respectively across which the reference voltage is developed from the bandgap reference circuit 11. The voltage reference support circuit 10 also has a positive supply terminal 16 and a negative supply terminal 18 labeled $+V_z$ and $-V_z$ respectively across which a supply voltage is developed for powering the bandgap reference circuit 11.

A bandgap reference 20 has positive and negative terminals. The positive terminal is connected to the positive reference terminal 12 and to the positive supply terminal 16 via a bias resistor 23 labeled $R_{bias}$. The negative terminal of the bandgap reference 20 is connected to ground. A bias current $I_{bias}$ is generated by the voltage reference support circuit 10 in combination with the resistor 23. The bias current $I_{bias}$ has a level selected to meet the requirements of the voltage reference 20.

It is desirable that the $+V_z$ voltage developed at the terminal 16 be ratiometrically scaled from the $+V_{ref}$ voltage so that the bias current $I_{bias}$ supplied to the bandgap reference circuit 11 improves the stability of $+V_{ref}$ over time and temperature. It is further desirable that a negative reference voltage be developed in a manner that closely tracks the positive reference voltage developed at $+V_{ref}$ by the bandgap reference 20.

Resistors 22 and 24, which are ratiometrically scaled resistors typically formed as a resistor network on a common device substrate, are connected in series across the positive and negative reference terminals 12 and 14. The resistance values of the resistors 22 and 24 are chosen to be equal values so that a unity gain voltage inverter may be formed with an amplifier 26. Because the resistors 12 and 14 are ratiometrically scaled, their respective resistance values will track closely over time and temperature with a minimum of components. The resistors 22 and 24 are connected to an inverting input of the amplifier 26. A non-inverting input of the amplifier 26 is connected to ground. An output of the amplifier 26 is coupled to the negative supply terminal 18 which is further connected to the negative reference terminal 14. The amplifier 26, in conjunction with the resistor network formed by the resistors 22 and 24, is configured as a unity gain voltage inverter referenced to ground to develop the negative reference voltage in a way that tracks the positive reference voltage with a minimum of additional components.

A resistor 28 is coupled in series with a resistor 30 as a second resistor network between the terminal 16 labeled $+V_z$ and the terminal 14 labeled $-V_{ref}$. The resistors 28 and 30 are connected to an inverting input of an amplifier 32. A non-inverting input of the amplifier 32 is coupled to the reference terminal 12 labeled $+V_{ref}$. An output of the amplifier 32 is connected to a transistor 34 that controls the current $I_{bias}$ which flows to the bandgap reference according to the resistance values of the resistors 28 and 30 and the voltage drop across the bias resistor 23. The transistor 34 is shown as a field effect transistor but which may comprise any of a variety of bipolar or other transistors used to control current flow, with the amplifier 32 appropriately connected. The transistor 34 is connected in series between the supply voltage +V and the bias resistor 23. A resistor 36 labeled $R_{start}$ typically having a relatively high resistance value is employed to ensure that the voltage reference support circuit 10 starts up properly to reach a known stable condition.

Because the $+V_{ref}$ voltage at the terminal 12 is known, along with the negative reference voltage $-V_{ref}$ at the terminal 14, the values of the resistors 28 and 30 may then be selected to set $+V_z$ to the desired level between the supply voltage +V and $+V_{ref}$. Because the resistors 28 and 30 are ratiometrically scaled, the $+V_z$ and $I_{bias}$ may be generated with relatively high accuracy. The amplifier 32, the transistor 34, and resistors 28 and 30 thus form a highly accurate voltage source that is ratiometrically scaled from $+V_{ref}$ and which remains substantially stable over a wide range of time and temperature variations as well as variations in the supply voltage +V.

It will be noted that the supply voltage +V, as well as a negative supply voltage (not shown) are provided to the amplifiers 26 and 32. These connections are not shown in order to simplify the circuit schematic drawings of FIG. 1, FIG. 2, and FIG. 3.

Figure 2:
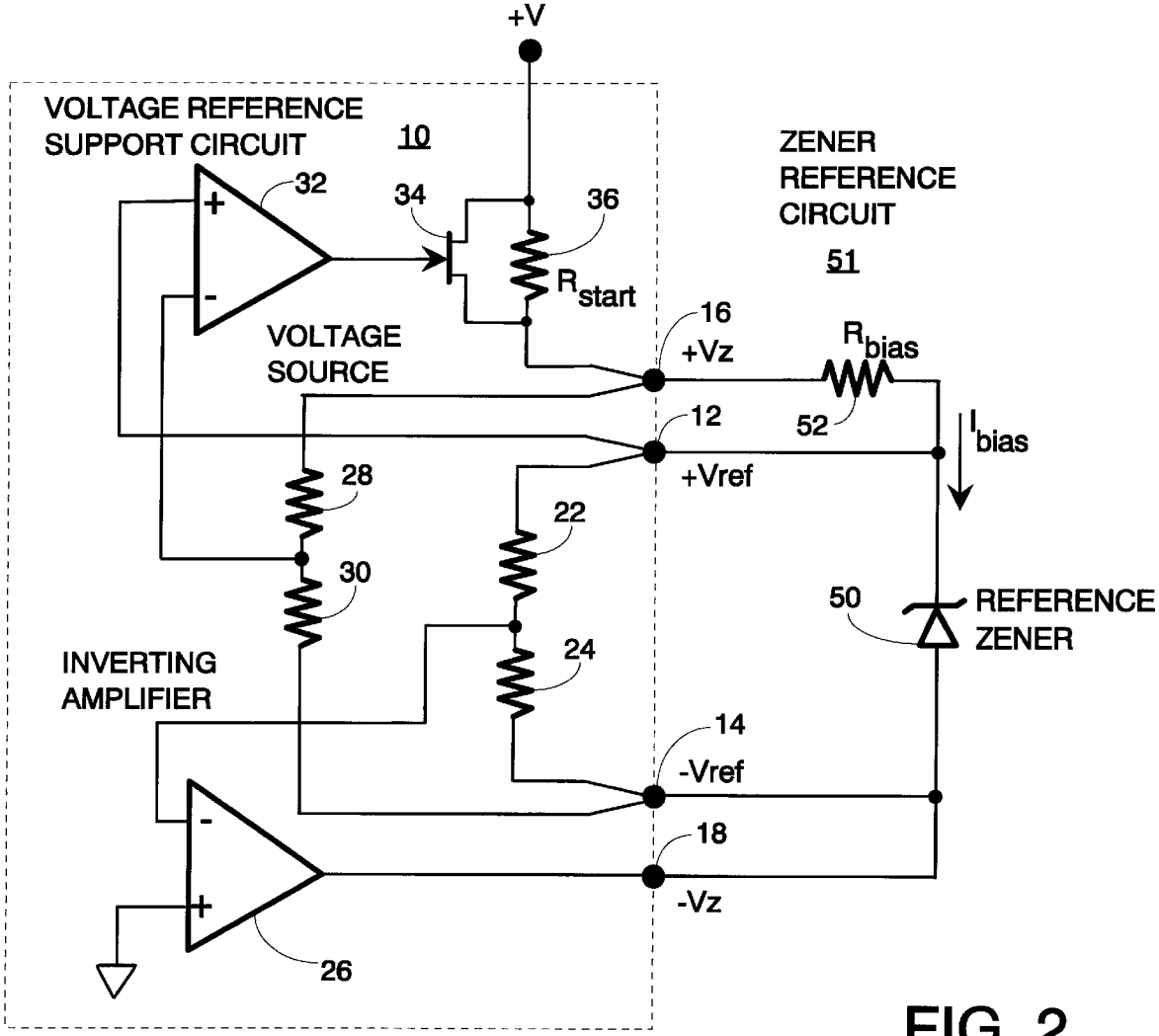
FIG. 2 is a schematic drawing of the voltage reference support circuit coupled to a zener reference circuit.

In FIG. 2, there is shown the voltage reference support circuit 10 now connected to a zener reference circuit 51. The zener reference circuit 51 consists of a reference zener 50 which develops a zener reference voltage when the current $I_{bias}$ set by the bias resistor 52 is sourced through it. A cathode end of the reference zener 50 is connected to the reference terminal 12 and to the positive supply terminal 16 via the bias resistor 52. An anode end of the reference zener 50 is connected to the negative reference terminal 14 and further connected to the negative supply terminal 18. The amplifier 32 is configured as a voltage source to set the positive reference voltage $+V_z$ to a voltage level ratiometrically scaled from the zener reference voltage by the resistors 28 and 30 so that the bias current $I_{bias}$ can be generated in the desired quantity required by the reference zener 50, which is determined according to the device specifications.

The reference zener 50 thus develops a zener reference voltage which spans both the positive reference voltage and the negative reference voltage. The negative reference voltage is generated by the amplifier 26 which is again configured as a unity gain voltage inverter with the resistors 22 and 24, with the non-inverting input referenced to ground. In this way, the positive reference voltage and the negative reference voltage are generated from the zener reference voltage and track each other with respect to ground. The bias current $I_{bias}$ is passed through the terminal 18 into the output of the amplifier 26 so that $-V_{ref}$ is not disturbed.

Thus, the voltage reference support circuit accommodates the bandgap reference 20 which generates a positive reference voltage which is referenced to ground as shown in FIG. 1 as well as the reference zener 50 which generates the zener reference voltage which includes both the positive and negative reference voltages.

Figure 3:
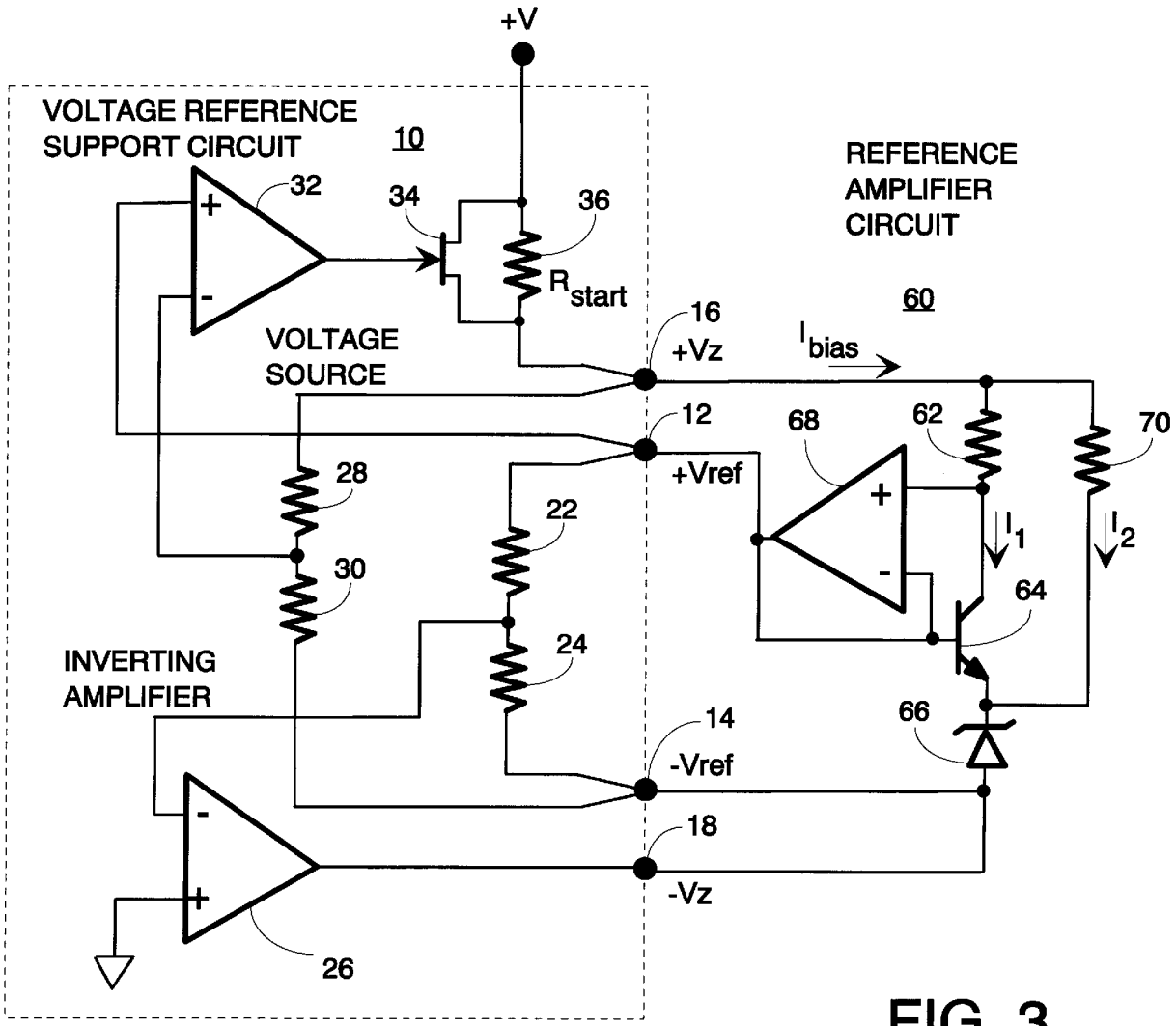
FIG. 3 is a schematic drawing of the voltage reference support circuit coupled to a reference amplifier circuit.

In FIG. 3, there is shown the voltage reference support circuit 10 connected to a reference amplifier circuit 60. The reference amplifier circuit 60 includes a resistor 62 coupled in series with a transistor 64 and further in series with a zener diode 66 between the positive supply terminal 16 and the negative reference terminal 14 and negative supply terminal 18. An amplifier 68 with a non-inverting input coupled to the collector of the transistor 64 and an inverting input and an output connected to the base of the transistor 64 sets the base potential to match the collector potential of the transistor 64 and provide the reference amplifier output. A resistor 70 is connected in shunt with the series combination of the resistor 62 and transistor 64. The positive supply voltage $+V_z$ generated by the voltage reference support circuit 10 is supplied to the resistors 62 and 70 so that currents $I_1$ and $I_2$ can be generated through the resistors 62 and 70 respectively. The currents $I_1$ and $I_2$ are the collector current through the transistor 64 and the zener current through the zener diode 66 respectively and are chosen to obtain a temperature coefficient of the reference voltage of substantially zero as well as low time drift according to known techniques. The zener diode 66 and the transistor 64 are preferably installed in the same device package in order to obtain the desired level of temperature tracking and stability.

The negative reference voltage is developed by the unity gain voltage inverter consisting of the amplifier 26 and the resistors 22 and 24. The positive supply voltage +Vz is supplied by the voltage source consisting of the amplifier 32, the resistors 28, and 30, 36, and the transistor 34. In this way, the positive reference voltage $+V_{ref}$ and the negative reference voltage $-V_{ref}$ are generated from the reference amplifier circuit 60 and track each other with respect to ground. Thus, the voltage reference support circuit accommodates reference amplifier circuit 60 which generates a reference voltage to obtain both the positive and negative reference voltages at the positive and negative reference terminals 12 and 14 respectively.

As demonstrated in FIG. 1, FIG. 2, and FIG. 3, the voltage reference support circuit 10 may be configured to provide a negative reference voltage from the positive reference voltage, to provide the negative and positive reference voltages from a zener reference voltage or a reference amplifier reference voltage, and provide a ratiometrically scaled positive supply voltage $+V_z$. In this way, the bias current $I_{bias}$ may be provided to the reference voltage circuit in a stable and known manner to achieve enhanced stability. By providing the voltage reference support circuit as a common circuit topology to support a variety of types of reference voltage circuits, a single monolithic component may be produced, achieving economy of scale to reduce manufacturing costs and component count as well as achieving design economy by reducing the need to re-design the circuitry surrounding a particular voltage reference circuit.

It will be obvious to those having ordinary skill in the art that many changes may be made in the details of the above described preferred embodiments of the invention without departing from the spirit of the invention in its broader aspects. For example, the transistor 34 which forms part of the positive supply voltage source may be eliminated if the output of the amplifier 32 has the capability to source the required amount of bias current $I_{bias}$. An output pass transistor similar to transistor 34 could be added to the amplifier 26 to improve its current handling capability. Other types of reference voltage circuits that generate a single reference voltage, either differentially or with respect to ground, and that require a stable bias current may readily benefit from the voltage reference support circuit 10. The present invention may also be readily adapted for voltage reference circuits that generate a negative reference voltage with respect to ground rather than a positive reference voltage. Therefore, the scope of the present invention should be determined by the following claims.

What I claim as my invention is:

1. A voltage reference support circuit, for supporting a plurality of voltage reference circuit types, comprising:

(a) a negative reference terminal and a positive reference terminal, said positive reference terminal coupled to a voltage reference circuit to receive a positive reference voltage, said voltage reference circuit comprising one of said plurality of voltage reference circuit types;

(b) a negative supply terminal and a positive supply terminal, said negative supply terminal coupled to said negative reference terminal and said positive supply terminal coupled to supply a bias current to said voltage reference circuit;

(c) an inverting amplifier, having a first resistor network coupled between said positive reference terminal and said negative reference terminal, for supplying a negative reference voltage to said negative reference terminal; and (d) a voltage sources having a second resistor network coupled between said positive supply terminal and said negative reference terminal, for supplying said bias current at said positive supply terminal.

2. A voltage reference support circuit according to claim 1 wherein said first resistor network comprises ratiometrically scaled resistors.

3. A voltage reference support circuit according to claim 1 wherein said second resistor network comprises ratiometrically scaled resistors.

4. A voltage reference support circuit according to claim 1 wherein said plurality of voltage reference circuit types comprises one of a bandgap reference, a reference zener, and a reference amplifier.

5. A voltage reference support circuit according to claim 4 wherein when said voltage reference circuit is said bandgap reference, said bandgap reference is coupled between said positive reference terminal and ground to generate a stable reference voltage across said first resistor network.

6. A voltage reference support circuit according to claim 4 wherein when said voltage reference circuit is said reference zener, said reference zener is coupled between said positive reference terminal and said negative reference terminal to generate a zener reference voltage across said first resistor network.

7. A voltage reference support circuit according to claim 4 wherein when said voltage reference circuit is said reference amplifier, said reference amplifier is coupled between said positive reference terminal and said negative reference terminal to generate a stable reference voltage across said first resistor network.

8. A voltage reference support circuit, for supporting a plurality of voltage reference circuit types, comprising:

(a) a negative reference terminal and a positive reference terminal, said positive reference terminal coupled to a voltage reference circuit to receive a positive reference voltage, said voltage reference circuit comprising one of said plurality of voltage reference circuit types;

(b) a negative supply terminal and a positive supply terminal, said negative supply terminal coupled to said negative reference terminal and said positive supply terminal coupled to supply a bias current to said voltage reference circuit;

(c) an inverting amplifier, having a first resistor network coupled between said positive reference terminal and said negative reference terminal, for supplying a negative reference voltage to said negative reference voltage terminal, said first resistor network comprising ratiometrically scaled resistors; and (d) a voltage source, having a second resistor network coupled between said positive supply terminal and said negative reference terminal, for supplying said bias current at said positive supply terminal, said second resistor network comprising ratiometrically scaled resistors.

9. A voltage reference support circuit according to claim 8 wherein said plurality of voltage reference circuit types comprises one of a bandgap reference, a reference zener, and a reference amplifier.

10. A voltage reference support circuit according to claim 9 wherein when said voltage reference circuit is said bandgap reference, said bandgap reference is coupled between said positive reference terminal and ground to generate a stable reference voltage across said first resistor network.

11. A voltage reference support circuit according to claim 9 wherein when said voltage reference circuit is said reference zener, said reference zener is coupled between said positive reference terminal and said negative reference terminal to generate a zener reference voltage across said first resistor network.

12. A voltage reference support circuit according to claim 9 wherein when said voltage reference circuit is said reference amplifier, said reference amplifier is coupled between said positive reference terminal and said negative reference terminal to generate a stable reference voltage across said first resistor network.

* * * * *